United States Patent [19]

Moynagh, Jr. et al.

[11] Patent Number: 4,533,204

[45] Date of Patent: Aug. 6, 1985

[54] RESILIENT CIRCUIT BOARD CONTACT

[75] Inventors: Eugene E. Moynagh, Jr., Afton; Donald J. Jansky, St. Paul, both of Minn.

[73] Assignee: Minnesota Mining and Manufacturing Company, St. Paul, Minn.

[21] Appl. No.: 410,321

[22] Filed: Aug. 23, 1982

[51] Int. Cl.[3] ..... H01R 4/24

[52] U.S. Cl. ..... 339/221 R; 29/882; 339/252 P

[58] Field of Search ..... 339/17 C, 220 R, 221 R, 339/221 M, 252 R, 252 P; 29/874, 882

[56] References Cited

U.S. PATENT DOCUMENTS

| | | | |
|---|---|---|---|
| 2,994,057 | 7/1961 | Donohue et al. | 339/17 C |
| 3,786,558 | 1/1974 | McCarthy | 339/252 P |
| 3,827,004 | 7/1974 | Vanden Heuvel et al. | 339/221 R |
| 3,917,375 | 11/1975 | Johnson | 339/112 R |
| 4,066,326 | 1/1978 | Lovendusky | 339/221 M |
| 4,155,321 | 5/1979 | Tamburro | 113/119 |
| 4,186,982 | 2/1980 | Cobaugh et al. | 339/17 C |
| 4,415,220 | 11/1983 | Kant | 339/221 R |

*Primary Examiner*—Gil Weidenfeld
*Assistant Examiner*—Gary F. Paumen
*Attorney, Agent, or Firm*—Donald M. Sell; James A. Smith; David W. Anderson

[57] ABSTRACT

An electrical contact to be inserted into a plated hole through a circuit board includes a mounting portion formed from a thin spline having outer edges and a central slit defining inner edges adjacent the slit which are offset with respect to the outer edges in a direction transverse to the plane of the spline to define outwardly radiused blades which increase the thickness of the spline and provide curved contact surfaces between the ends of the spline and the inner and outer edges of the blades.

2 Claims, 7 Drawing Figures

RESILIENT CIRCUIT BOARD CONTACT

BACKGROUND OF THE INVENTION

1. Technical Field of the Invention

This invention relates in general to electrical contacts, and particularly to a contact adapted for insertion into a plated hole in a printed circuit board.

2. Description of the Prior Art

Circuit board contacts which include a body portion for connection to an electrical device and a mounting portion adapted for insertion into a conductively plated through-hole in a circuit board are well known in the electrical arts and assume a variety of configurations. A first type is described in U.S. Pat. No. 2,994,057 and includes a solid mounting portion provided with ridged fins which is press fitted into the circuit board hole. This type of contact has not proven suitable since the circuit board is relatively fragile and is easily damaged by the high radial and axial forces produced during the press fitting operation and because the fins tend to dig into and injure the hole plating.

An improved contact of this type is described in U.S. Pat. No. 3,827,004 in which the mounting portion of the contact is generally H-shaped with four fins which collapse upon insertion into the circuit board hole. Although the four fins tend to collapse uniformly and accurately locate the contact within the circuit board hole, they do not have sufficient resiliency to maintain a relatively high retention force between the mounting portion and the circuit board hold.

Another type of contact includes a mounting portion which is flattened and split to form two branches separated like the eye of a needle that provide a resilient interference fit between the contact and the hole as described in U.S. Pat. No. 3,917,375. Although this contact advantageously requires a low insertion force and produces a relatively high retention force due to the spring action of the branches, the area of the contact engaging the hole is not sufficient to insure accurate location of the contact and does not provide for efficient heat transfer or secure electrical engagement.

U.S. Pat. No. 4,066,326 provides three resilient branches by twice splitting the mounting portion of the contact and separating the central branch in a direction opposite to that of the two outer branches. The three branches triangularly contact the circuit board hole and more positively locate the contact with respect to the circuit board than does the previous branched contact. However, the engagement area between the contact and the hole is still relatively small and does not provide efficient electrical engagement or heat transfer between the contact and the plated circuit board hole.

Another type of branched contact is described in U.S. Pat. No. 4,186,982 in which the mounting portion of the contact is sheared but the two branches thus formed are offset parallel to the shear plane rather than perpendicularly as in U.S. Pat. No. 3,917,375. This configuration is designed to create a high retention force, but does so at the expense of an undesirably high insertion force. In addition, the area of contact between the mounting portion and the hole is again relatively small.

In addition to the specific disadvantages associated with the various types of contacts and noted above, all of the contacts described thus far have a common disadvantage in that a relatively large mass of material must be availble at the mounting portions of the contacts in order to form the configurations which grip the circuit board hole. If the portion of the contact which extends above the circuit board for connection to an electrical device is to be thin and narrow, as is typically the case, material must be removed and discarded which causes machining expense and waste.

U.S. Pat. No. 4,155,321 discloses a contact which eliminates this waste by starting with a thin sheet and rolling the mounting portion into a resilient cylinder which is inserted into the circuit board hole. While this contact provides a low insertion force, a relatively high retention force, and a large engagement area between the contact and the circuit board, it is relatively expensive to manufacture because the rolling operation is difficult to perform and a large amount of material is necessary to form the cylinder.

SUMMARY OF THE INVENTION

An electrical contact according to the present invention provides a deformed mounting portion adapted to be inserted into a plated through-hole in a printed circuit board, which mounting portion accurately centers the contact structure in the hole, requires a low insertion force while producing a relatively high retention force within the hole, and which contacts a large area of the mounting hole to efficiently transfer heat and provide secure electrical engagement between the contact and the plated hole.

The mounting portion of the conact includes a thin spline having outer edges and a centrally slit portion with inner edges of the spline adjacent the slit being oppositely offset transverse to the plane of the spline and the outer edges to define outwardly radiused blades which increase the thickness of the spline and provide oppositely curved contact surfaces between the ends of the spline and the inner and outer edges of the spline.

BRIEF DESCRIPTION OF THE DRAWINGS

The present invention will be more thoroughly described with reference to the accompanying drawings wherein like numbers refer to like parts in the several views, and wherein.

DETAILED DESCRIPTION OF INVENTION

Figure 1:
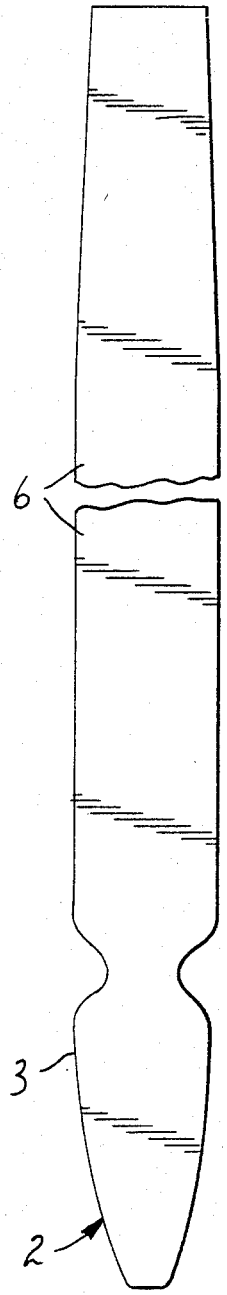
FIG. 1 is a plan view of a first embodiment of an electrical contact according to the present invention prior to forming.

Referring now to the drawings, and in particular FIG. 1, there is shown an electrical contact 2 in blank, prior to forming. The contact blank 2 is formed in a narrow, thin sheet or spline 3 and is rectangular in cross-section throughout its length. The contact blank 2 is formed of a metal, preferably a copper alloy having a relatively high modulus of elasticity in order to provide good resiliency and spring characteristics.

Figure 2:
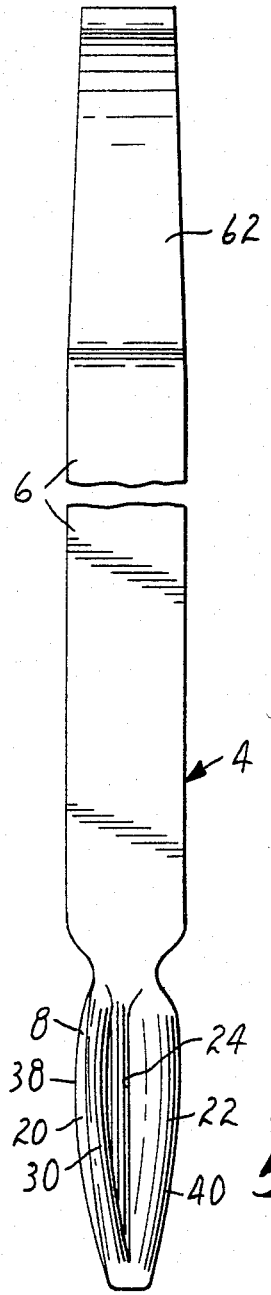
FIG. 2 is a plan view of the electrical contact of FIG. 1 after forming.
Figure 3:
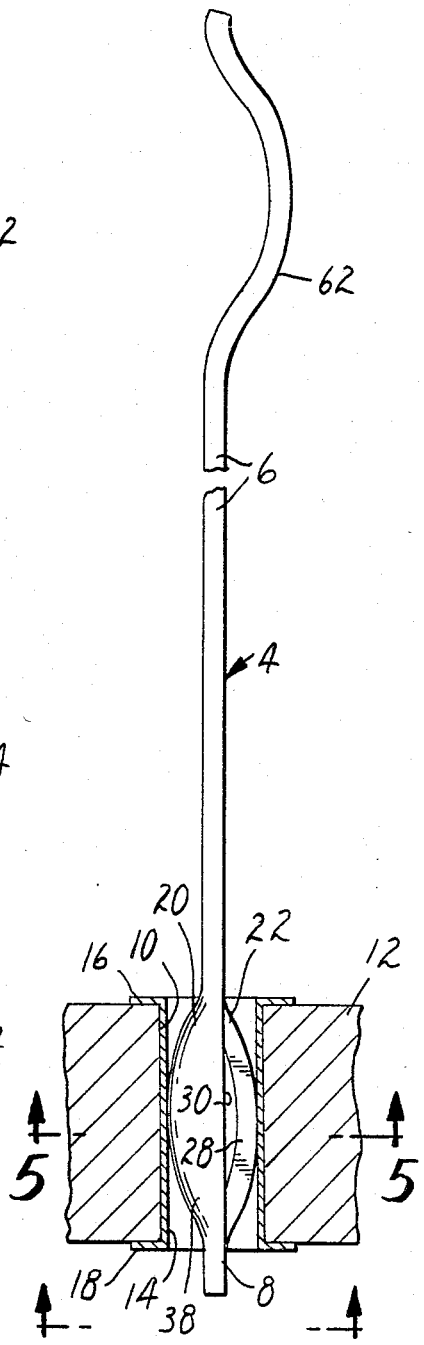
FIG. 3 is an elevational view of the contact of FIG. 1 inserted into a plated through-hole formed in a printed circuit board which is shown in fragmentary cross-section.

FIGS. 2 and 3 illustrate an electrical contact, generally indicated as 4, which is formed from the blank 2 and includes a body portion 6 and a mounting portion 8. The mounting portion 8 of the contact 4 is adapted to be inserted into a through-hole 10 formed in a printed circuit board 12 which hole typically includes an electrically conductive plating 14 throughout which connects circuit elements 16 and 18 located on opposite sides of the circuit board 12.

The mounting portion 8 of the contact 4 includes two bowed blades 20 and 22 which extend oppositely from a slit 24 centrally cut in the contact mounting portion 8 to increase the thickness of the contact spline 3.

Figure 4:
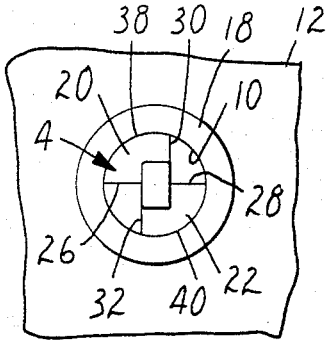
FIG. 4 is an end view of the contact of FIG. 1 taken from the perspective of line 4—4 of FIG. 3.
Figure 5:
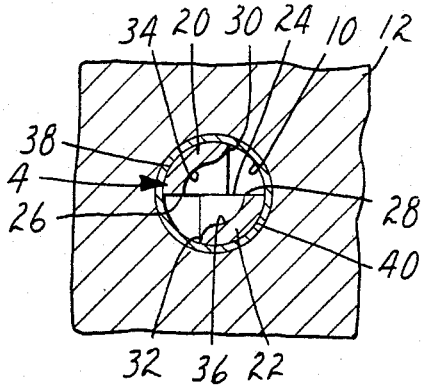
FIG. 5 is a cross-sectional view of the contact of FIG. 1 and the circuit board taken generally along the line 5—5 of FIG. 3.

As best seen in FIGS. 4 and 5, the blades 20 and 22 are formed by offsetting inner edges 26 and 28 of the spline 3 adjacent the central slit 24 with respect to outer edges 30 and 32 of the contact spline 3 in a direction transverse to the major surfaces of the spline 3.

Between the inner edges 26 and 28 and outer edges 30 and 32 of the blades 20 and 22, there are formed oppositely curved inner surfaces 34 and 36 and oppositely curved convex outer contact surfaces 38 and 40. The outer contact surfaces 38 and 40 are radiused to conform to the circuit board through-hole 10 and engage a large area of the plating 14 connecting the sides of the circuit board 12. As best seen in FIG. 5, the blades 20 and 22 engage greater than 50 percent of the circumference of the circuit board through-hole 10.

Figure 6:
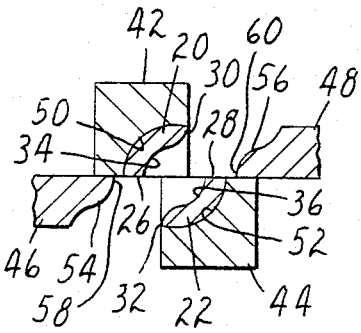
FIG. 6 is a cross-sectional view of the electrical contact taken generally along the line of 5—5 of FIG. 3 and also illustrating the tooling used to form the contact.

FIG. 6 illustrates the method of forming the bowed blades 20 and 22. There are provided two female dies 42 and 44 into which the blank contact spline 3 is inserted and two opposed male dies 46 and 48 which may be moved toward the contact spline 3 and the female dies 42 and 44. The female dies 42 and 44 include concave surfaces 50 and 52 which shape the contact surfaces 38 and 40 of the blades 20 and 22 between the inner edges 26 and 28 and outer edges 30 and 32 of the contact spline 3. The male dies 46 and 48 include convex surfaces 54 and 56 which form the inner curved surfaces 34 and 36 of the blades 20 and 22 and leading edges 58 and 60 which offset the inner edges 26 and 28 of the contact spline 3 in opposite directions away from the outer edges 30 and 32 of the blades 20 and 22 and transverse to the major surfaces of the contact spline 3. The slit 24 defining the inner edges 26 and 28 of the blades 20 and 22 may be cut into the contact spline 3 prior to insertion into the female dies 42 and 44 or may be cut by the leading edges 58 and 60 of the male dies 46 and 48 as the blades 20 and 22 are formed.

Since the blades 20 and 22 are formed with a relatively gentle bow from end to end to produce a transitional slope, and because the blades 20 and 22 are able to move inwardly independently of each other, a relatively low force is needed to insert the mounting portion 8 of the contact 4 into the through-hole 10 and there is little danger of damaging either the circuit board 12 or the plating 14. However, since the contact 4 is preferably formed from a copper alloy having a relatively high modulus of elasticity, and, therefore, high resiliency and spring properties, the blades 20 and 22 exert a relatively high retention force on the circuit board hole 10 after insertion. Although the force necessary to withdraw the contact 4 is not as great as the force required to insert the contact 4 because the hole plating 14 is smoothed somewhat by insertion of the contact 4, the retention force is a large percentage of the insertion force and is entirely adequate to maintain the position of the contact 4 within the hole 10 and a gas-tight seal between the contact 4 and the hole plating 14.

Advantages realized by the above-described manner of forming the mounting portion 8 of the contact 4 are efficient heat transfer and secure electrical engagement between the plating 14 and the contact 4 due to the large mating area between the plating 14 and the contact 4 and that the contact 4 is accurately centered in the circuit board hole 10 because the blades 20 and 22 symmetrically extend from the spline 3 and, again, because there exists a large area of engagement between the hole 10 and the contact 4. In addition, material is not wasted since the mounting portion 8 of the contact 4 is initially the same width and has the same cross-sectional area and shape as the body portion 6 of the contact 4. Therefore, material need not be removed from either the mounting portion 8 or the body portion 6 of the contact blank 2 to form the completed contact 4.

As shown in FIG. 3, the body portion 6 of the contact 4 includes a recurved terminal 62 opposite the mounting portion 8 which may be used to electrically connect the circuit board 12 and a discrete electrical device (not shown) which may be mounted on the circuit board 12. Although for clarity only one contact 4 has been shown, it is contemplated that the contact 4 would be most usefully utilized in conjunction with other identical contacts 4 arranged in parallel rows and encapsulated in a structure which included apertures providing access to the terminal 62 into which the legs of a discrete electronic device, such as an integrated circuit, may be inserted. The mounting portions 8 of the contacts 4 would then be inserted into parallel rows of plated holes 10 in the circuit board 12 to electrically connect the electronic device and the circuit board 12.

Figure 7:
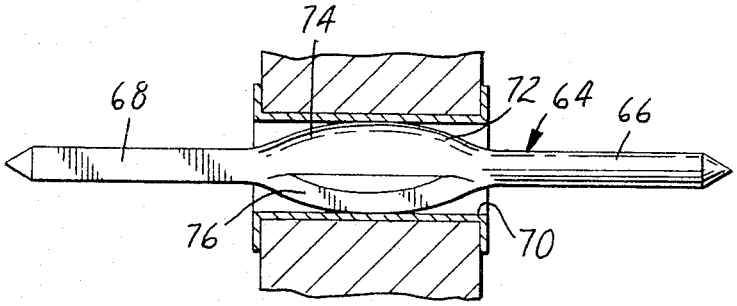
FIG. 7 is a sectional view of a circuit board and a second embodiment of an electrical contact according to the present invention.

However, the utility of the contact 4 is not limited to the application just described. As illustrated in FIG. 7, a contact 64 could be formed with axially-extending body portions 66 and 68 which may be circular or square in cross-section as shown, or which may assume any other desirable configuration. The square configuration would be most commonly used to provide for wire-wrap connections to a plated circuit board hole 70 and the circular configuration would be used for mating with a variety of sliding contacts commonly known as socket contacts.

If a solid non-rectangular body portion 66 or 68 such as shown in FIG. 7 is desired, a portion of the contact 64 would be flattened to form a spline 72 necessary for the formation of mounting blades 74 and 76 identical to the blades 20 and 22 described above with respect to FIGS. 1–6. It should be apparent that the body portions 66 and 68 need not extend in both directions from the circuit board hole 74.

Furthermore, although the present invention has been described with respect to electrical applications in which it is desirous to make electrical contact with a plated hole in a circuit board, the invention should not be so limited. The present invention has general utility in mechanical and/or electrical applications in which it is desirable to connect a shaft or object to a hole, and it is contemplated that the mounting portion of the invention be formed of a material other than metal, such as plastics, or of metals other than copper alloys which are preferred in electrical applications.

The foregoing detailed description is given for clearness of understanding only and no unnecessary limitations should be understood therefrom, as modifications will be obvious to those skilled in the art.

We claim:

1. A resilient contact including a mounting portion adapted for insertion into and engagement with a circular hole formed in a circuit board, said mounting portion having a longitudinal axis coincident with the axis of said circular hole when said mounting portion is inserted into said hole and comprising:

a thin spline having two major surfaces parallel to said longitudinal axis and a generally rectangular cross-section in a plane perpendicular to said longitudinal axis and two oppositely curved blades, each extending laterally outward from one of said major surfaces and being symmetrically disposed with respect to said longitudinal axis, the blades having inner edges which slide relative to one another each blade having an outer surface with an essentially constant maximum radius in said plane perpendicular to said longitudinal axis corresponding to the radius of said circular hole when said mounting portion is inserted into said circular hole and an essentially constant thickness substantially equal to the thickness of said spline so that said blades define substantially 90 degree sectors of a tubular cylinder in said plane perpendicular to said longitudinal axis, said outer radius of each of said blades decreasing in both longitudinal directions from said maximum radius so that said blades join said spline at opposite longitudinal ends to longitudinally bow said blades and faclitate insertion and removal of said mounting portion with respect to said circular hole.

2. A method of forming resilient contact adapted for insertion in a circular hole comprising the steps of:

providing a flat elongated sheet of resilient metal having a longitudinal axis coincident with the axis of said circular hole when said contact is inserted in said circular hole and two major surfaces in planes parallel to said longitudinal axis, said sheet having a rectangular cross-section in a plane perpendicular to said longitudinal axis:

slitting said sheet longitudinally between the ends of said sheet to produce two rectangularly cross-sectioned ends connected by two blades each having an outer longitudinal edge and an inner longitudinal edge adjacent said slit;

offsetting said inner edges of said blades in opposite directions transverse to said planes of said major surfaces of said rectangular cross-sectioned ends with said offsetting of said inner edges progressively decreasing toward both rectangular cross-sectioned ends from a maximum located approximately midway along the longitudinal lengths of said blades so that said blades are longitudinally bowed; and curving each of said blades outwardly with respect to said longitudinal axis between said inner and outer longitudinal edges so that each blade has a circular outer surface in a plane perpendicular to said longitudinal axis corresponding in radius at said maximum offsetting to the radius of said circular hole when said contact is inserted into said circular hole so that each blade forms a substantially 90 degree sector of a tubular cylinder in a plane perpendicular to said longitudinal axis.

* * * * *